US005875842A

United States Patent [19]

Wyatt

[11] Patent Number: 5,875,842

[45] Date of Patent: Mar. 2, 1999

[54] MULTI-IMPACT JARRING APPARATUS AND METHOD FOR USING SAME

[76] Inventor: Wilfred B. Wyatt, 201 Greenbriar Dr., Houma, La. 70364

[21] Appl. No.: 611,992

[22] Filed: Mar. 5, 1996

[51] Int. Cl.[6] ..... E21B 31/107

[52] U.S. Cl. ..... 166/178; 175/299

[58] Field of Search ..... 166/301, 178; 175/299, 302, 305

[56] References Cited

U.S. PATENT DOCUMENTS

| | | | |
|---|---|---|---|
| 4,463,815 | 8/1984 | Jürgens et al. | 166/178 X |
| 4,665,998 | 5/1987 | Burton | 166/178 X |
| 5,103,903 | 4/1992 | Marks, II | 166/178 |
| 5,139,086 | 8/1992 | Griffith, Jr. | 166/178 |
| 5,156,211 | 10/1992 | Wyatt | 166/301 |
| 5,170,843 | 12/1992 | Taylor | 166/301 |
| 5,330,018 | 7/1994 | Griffith | 166/178 X |

*Primary Examiner*—William P. Neuder
*Attorney, Agent, or Firm*—Michael D. Carbo

[57] ABSTRACT

A multi-impact jarring apparatus for retrieving objects stuck within a well bore comprises (1) an operating mandrel reciprocatively mounted within an upper housing attached to a fishing operating string, the mandrel acting as a hammer against the housing for creating a series of successive upwardly directed impact forces, (2) a releasable spring compressible between the mandrel and an upper portion of the housing and responsive to tension applied to the operating string, (3) releasable latching means for releasing the mandrel from the upper portion of the housing when the latching means is moved past a preset release position. The movement of the mandrel responsive to tensional force of the operating string allows for sudden release of the release spring and causes sudden upward movement of the mandrel resulting in impact of the mandrel against the upper portion of the housing and in immediate reposition of the latching means to reconnect the mandrel and a bottom portion of the upper housing body. Continued movement of the mandrel responsive to tensional force in the operating string repeats the impact and movement can be continued through a preset number of impact cycles. A second mandrel reciprocatively mounted within a lower housing can achieve successive downward impacts through a preset number of impact cycles.

2 Claims, 9 Drawing Sheets

MULTI-IMPACT JARRING APPARATUS AND METHOD FOR USING SAME

BACKGROUND OF THE INVENTION

The present invention relates generally to a fishing apparatus used within a well bore to remove from the well bore broken or stuck equipment or small non-drillable materials. "Fish" is a generic name for an object to be removed and may be anything from part or all of a drill string to smaller pieces of equipment such as bit cones, pieces of tools, or any material accidentally dropped into a well bore. Even small pieces of iron pyrite, which occurs naturally in some formations, may work loose and block drilling.

In cased wells, there are various types and kinds of problems that occur which create fishing jobs, such as objects being dropped into the well, packers to be retrieved, parted tubing, collapsed casing, dropped pipe, and wirelines either parted or stuck. Some of the most common fishing problems which can occur are:

(1) Differential pressure sticking—This is a condition in which a drill stem becomes stuck against the wall of a well bore because part of the drill stem (usually a drill collar) has become embedded in filter (or wall) cake;

(2) Under gauge hole—Sometimes mud filter cake builds excessively across a low pressure permeable formation. A drill string and logging tools can easily become stuck in the under gauge hole and filter cake;

(3) Key seats—Key seats develop where there is a sudden change in hole deviation or above a washout in a deviated hole. Sticking usually occurs as pipe is pulled into a key seat;

(4) Tapered hole—Hard abrasive formations can cause gauge wear on a drilling bit, which results in a tapered or carrot shaped hole. If a new bit is not reamed to the bottom when this situation exists, the bit will jam in the under gauge hole;

(5) object alongside drill string—Occasionally, an object such as a wrench, bolt, slip or tong part, or hammer will fall into the hole alongside the drill string. Except when the drill string pulls around the object or the object can be pushed into the hole wall, serious fishing problems can develop. This is especially true if drill pipe is jammed to one side in a cased hole;

(6) Inadequate hole cleaning—Inadequate hole cleaning occurs as a result of a drill string washout above the bit, low circulation rate in a large hole with an unweighted mud system, sloughing shake, a gravel bed in the shallow portion of the hole, and/or partial returns;

(7) Twist off—Drill string twist-offs are a result of a faulty drill string, stress reversals in a sharply deviated hole, drilling with drill pipe in compression, and poorly stabilized drill collars;

and (8) Junk in the hole—Inability to make hole and/or irregular torquing after picking up a new bit indicates junk in the hole below the bit. The junk could be bit cones, float collar or wiper plug debris, rig tools, slip elements, joint (or joints) of backed off casing, or other items. In any case, the junk must be fished out of the hole.

In clearing an object stuck downhole in a cased well, it is common practice to employ a catching or retrieving tool to obtain a hold on the stuck object, known as a fish, and a jarring tool, also called a fishing jar or simply a jar, which is capable of delivering a jarring or impact force to the fish in an effort to free it and remove it from the well bore. Designs of conventional fishing jars are of two basic types, hydraulic or mechanical, and either type is designed to deliver a single impact or jarring force to the fish during each jarring operation. A principal difference between the two types is in the method of locking and releasing a mandrel to cause the jar to impact or fire.

A fishing jar of the hydraulic type usually has a mandrel with an attached sliding valve, the mandrel fitting closely in a restricted bore in an outer housing. When a jarring force is required, tension is applied to move the mandrel relative to the housing. Fluid contained within the housing restricts movement of the mandrel relative to the housing, thereby providing a temporary delay before the mandrel is released to produce a jarring force. By increasing or decreasing initial tension applied to the jar, the resulting jarring force may be varied to some extent. When a mandrel is released, the energy stored in the stretched pipe or other operating string to which the fishing jar is connected accelerates the jar mandrel rapidly to its fully extended position against a stop. The stop converts kinetic energy of the rapidly moving mass of the pipe string into an intense jarring force which is transmitted through an overshot or spear catching tool to a stuck object or fish.

Mechanical fishing jars use a mandrel to compress a series of disk springs (instead of using trapped fluid) to restrain the movement of the mandrel relative to the housing. A latch mechanism is utilized to retain and then release the mandrel when the disk springs have been compressed to a predetermined point. As in a hydraulic fishing jar, when a mandrel is released, energy stored in the stretched fishing string accelerates the jar mandrel rapidly to its fully extended position against a stop. This sudden stop converts kinetic energy of the rapidly moving mass of the fishing string into an intense jarring force, which is transmitted to the fish.

In several of the most common fishing problems that occur, it would be a decided advantage if a fishing jar could deliver a series of rapid impact forces or blows upward against a stuck fish in order to initiate upward movement of the fish in the well bore. In a number of these fishing problems, it would be a decided advantage if a fishing jar could also deliver a series of rapid impact forces downward against a stuck fish, and then deliver a series of rapid impact forces upward against a stuck fish in order to initiate or increase upward movement of the fish in the well bore.

Accordingly, it is an object of the invention to provide an apparatus for retrieving an object stuck within a well bore, the apparatus delivering a series of rapid upward impact forces against a stuck object.

It is a further object of the invention to provide an apparatus for retrieving an object stuck within a well bore, the apparatus delivering a series of rapid downward impact forces against a stuck object or, alternately, delivering a series of rapid upward and downward impact forces against a stuck object.

It is a further object of the invention to provide an apparatus for a fishing jar operation to selectively control the number and frequency of impact forces delivered in a series of rapid downward and upward impact forces.

Accordingly, it is an object of the invention to provide method for retrieving an object stuck within a well bore by delivering a series of rapid upward impact forces against a stuck object.

It is a further object of the invention to provide method for retrieving an object stuck within a well bore by delivering a series of rapid downward impact forces against a stuck object or, alternatively, by delivering a series of rapid upward and downward impact forces against a stuck object.

It is a further object of the invention to provide a method for a fishing jar operation to selectively control the number and frequency of impact forces delivered in a series of rapid downward and upward impact forces.

It is a further object of the invention to provide a variation of intensity for each impact force delivered in series of downward and upward impact forces.

If a drill string becomes stuck in a well bore, it must be jarred loose and removed, or else the drill string must be parted and the lower segment must be fished out, ground through, or drilled around. A jar that is connected in a drill string is called a drilling jar. Accordingly, it is a further object of the invention to provide a jarring apparatus capable of being used in a drill string to deliver a series of upward jarring forces or, alternatively, to deliver a series of downward and upward jarring forces.

Yet another object of the invention is to provide a method for delivering a series of rapid impact forces to free a stuck drill string.

SUMMARY OF THE INVENTION

To achieve the foregoing and other objects and advantages of the invention, and in accordance with the purposes of the invention as broadly described herein, an embodiment of a multi-impact tool according to the invention comprises: (a) a first operating mandrel reciprocatively mounted within an upper housing body with the mandrel and the upper housing body being adapted to be connected to a fishing operating string, the mandrel and the upper housing body forming a first impact hammer and a first impact anvil, respectively, for creating a series of successive upwardly directed impact forces, (b) a first impact release spring adapted to be compressed between the first mandrel and the upper housing body, responsive to tension applied to the operating string, and (c) first releasable latching means connected between the first mandrel and a bottom portion of the upper housing body for releasing the first mandrel from the upper housing body when the first latching means is moved past a preset release position, the sudden release of the first impact release spring causing sudden upward movement of the first mandrel responsive to the tensional force of the operating string and resulting in impact of the first hammer with the first anvil and in the immediate repositioning of the first releasable latching means to reconnect the first mandrel and a bottom portion of the upper housing body. Continued movement of the first mandrel responsive to the tensional force of the operating string again results in sudden release of the first impact release spring, causing sudden upward movement of the first mandrel and repeating the impact of the first hammer with the first anvil, and continues this cycling through a preset number of impact cycles available in the tool.

To achieve the foregoing and other objects of the invention, and in accordance with the purposes of the invention as broadly described herein, an embodiment of a multi-impact tool according to the invention further comprises; (d) a second operating mandrel reciprocatively mounted within a lower housing body with a second mandrel and the lower housing body being adapted to be connected to the lower portion of the impact tool, the second mandrel and the lower housing body forming a second impact hammer and a second impact anvil, respectively, for creating a series of successive downwardly directed impact forces, (e) a second impact release spring, adapted to be compressed between the second mandrel and the lower housing body, responsive to weight of the fishing string, (f) second releasable latching means connected between the second mandrel and a bottom portion of the lower housing body for releasing the second mandrel from the lower housing body when the second latching means is moved past a preset release position, the sudden release of the second impact release spring causing sudden downward movement of the second mandrel responsive to the compressional force from the weight of the fishing string and resulting in impact of the second hammer with the second anvil and in the immediate repositioning of the second releasable latching means to reconnect the second mandrel and a bottom portion of the lower housing body. Continued movement of the second mandrel responsive to the compressional force of the operating string again results in sudden release of the release spring causing sudden downward movement of the second mandrel and repeating the impact of the hammer with the anvil, and continues this cycling through a preset number of impact cycles available in the tool.

To achieve the foregoing and other objects and advantages of the invention, and in accordance with the purposes of the invention as broadly described herein, a method for retrieving objects stuck within a well bore comprises the steps of: (1) compressing a first release spring between a first mandrel and an upper housing body, by applying tension to a fishing or operating string, until the first mandrel is released when the first release spring has moved past a preset release position, resulting in impact of the first mandrel with the upper housing body; (2) immediately after impact of the first mandrel with the upper housing body, repositioning upward releasable latching means connected between the first mandrel and a bottom portion of the upper housing body by continuing to apply tension to compress again the first release spring past another preset release position to again release the first mandrel, resulting in another impact of the first mandrel with the upper housing body; and (3) immediately after impact of the first mandrel with the upper housing body, further repositioning the releasable latching means by continuing to apply tension to again compress the first release spring past yet another preset release position to again release the mandrel, resulting in yet another impact of the first mandrel with the upper housing body, (4) repeating step 3 until a full series of impact cycles has occurred, at which time tension to the fishing or operating string is released. The jar now closes and is ready for the operator to apply tension again to the fishing or operating string and to produce another series of rapid upward impact blows to the fish as described herein or to create a series of successive downwardly directed impact forces. Successive downwardly directed impact forces are generated by (5) applying weight to the fishing string above the tool apparatus, thereby compressing a second release spring between a second mandrel and the a bottom portion of the lower housing body until the second mandrel is released when the second release spring has moved past a preset release position resulting in downward impact of the second mandrel with the lower housing body; (6) immediately after impact of the second mandrel lower housing with the lower housing body, repositioning downward releasable latching means connected between the second mandrel and a bottom portion of the lower housing body by applying tension to compress again the second release spring upward past another preset release position; (7) releasing the second mandrel again resulting in downward impact of the mandrel with the body; and (8) immediately after downward impact of the hammer striking the anvil, further repositioning the downward releasable latching means to compress again the release spring upward past yet another preset release position when the mandrel is again released, resulting in another downward impact of the mandrel with the body.

BRIEF DESCRIPTION OF DRAWINGS

A greater appreciation of the objects and advantages of the invention may be understood by the below set forth description taken in conjunction with the drawings, wherein:

FIGS. 2(*b*), 3(*b*), 7, 8 and 9 are sectional views of the lower portion of the downhole fishing jar mechanism of FIG. 1(*a*), showing impact level selector and actuator, torsional tension section, spring section, impactor, anvil and impactor releasing assembly components of the jar tool at selected times during jar operation.

FIG. 2(*a*) shows the upper portion of the downhole fishing jar mechanism in a closed position ready for tension to be applied to produce a series of upward impacts.

FIG. 2(*b*) depicts the lower portion of the downhole fishing jar mechanism in a closed position.

FIG. 3(*a*) depicts the upper portion of the downhole fishing jar mechanism with tension applied to the fishing string and thus to the jar in which:

Figure 1:
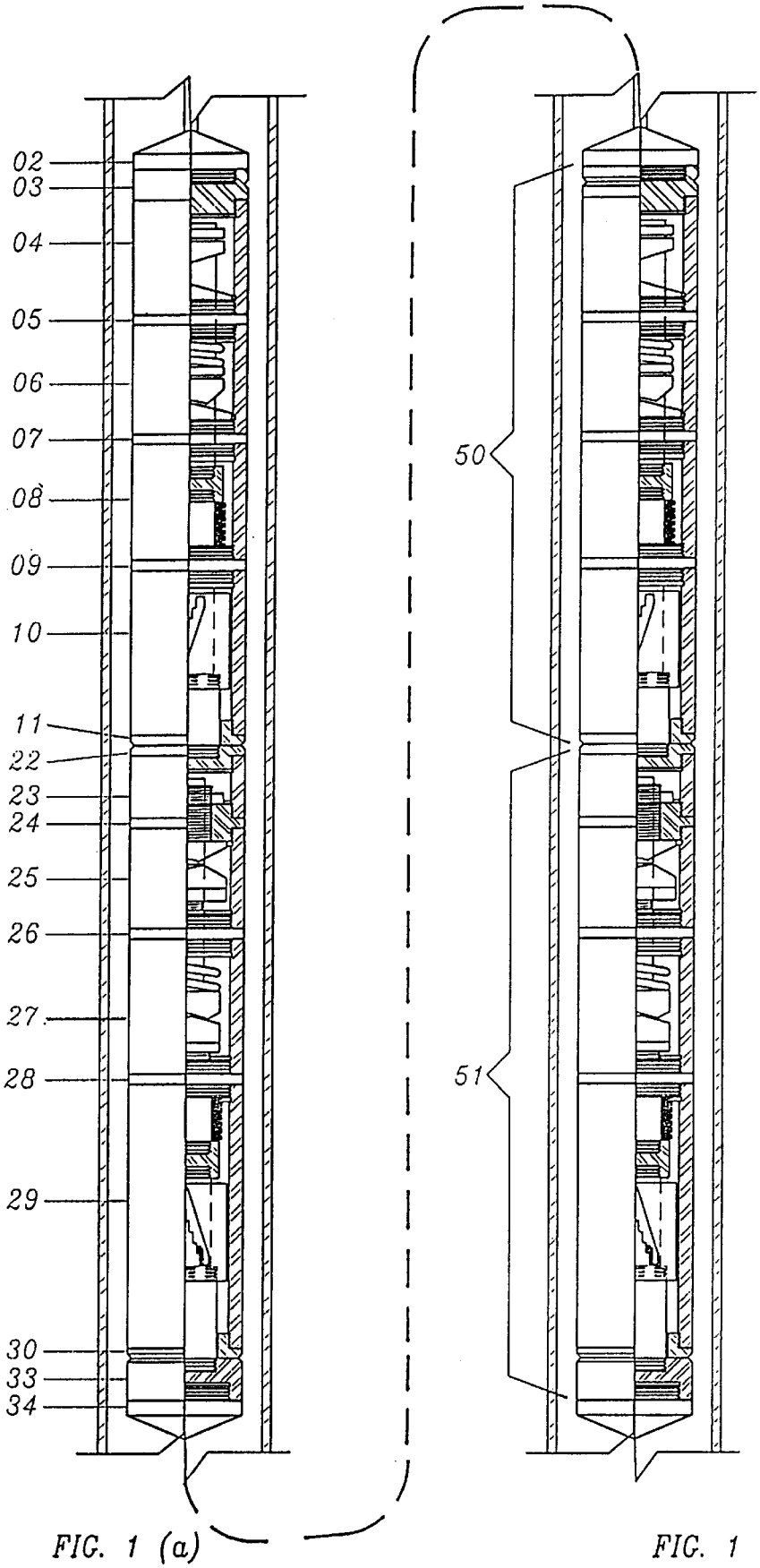
FIGS. 1(*a*) and 1(*b*) are partial sectional elevational views of an upper portion and a lower portion, respectively, of a downhole jar mechanism according to the invention, showing the mechanism as positioned within a well casing.
Figure 4:
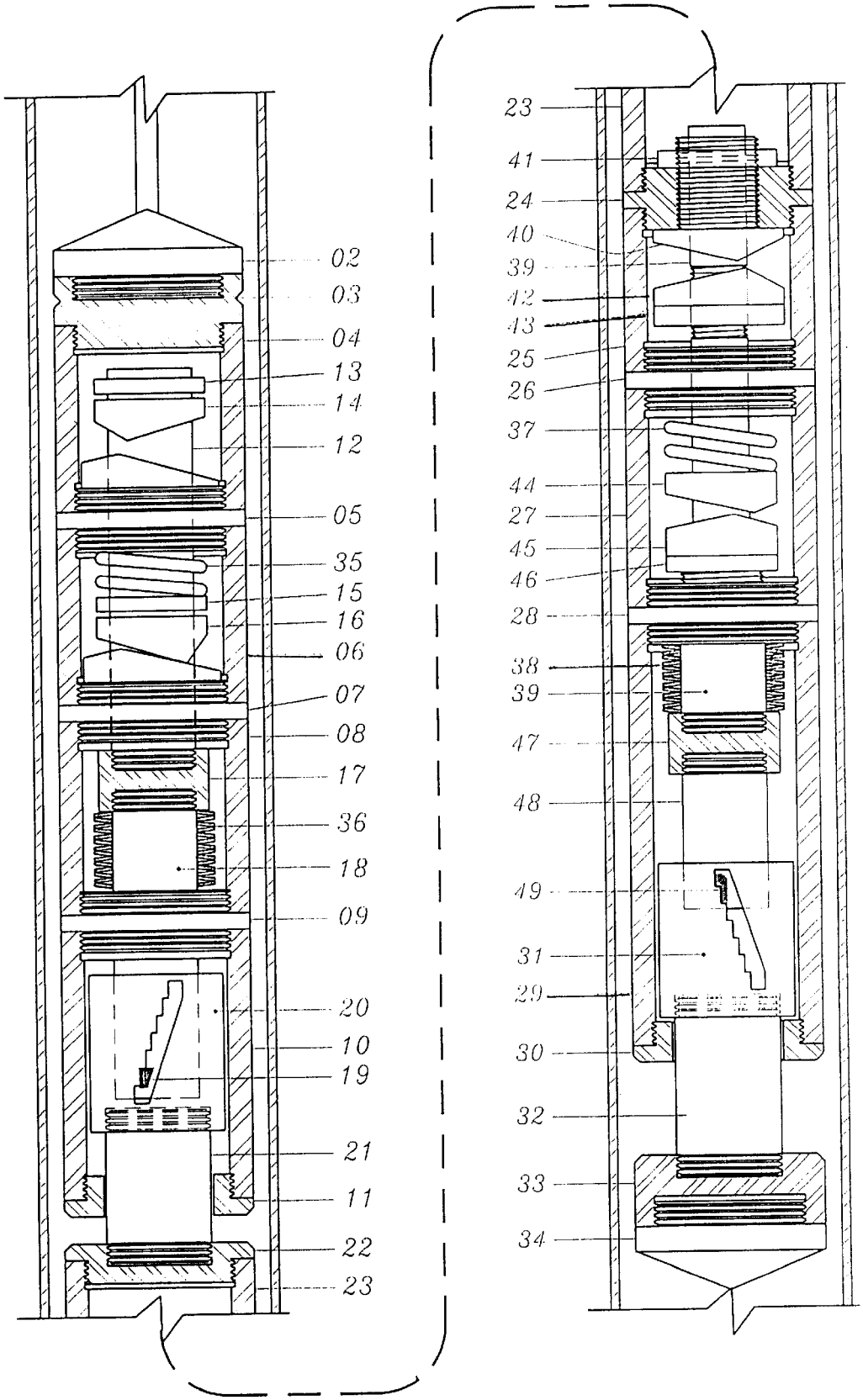

(1) The cam surface of upper impact level selector 14 acting against the cam surface of upper cycle connector 5 has rotated upper shaft 12 in a clockwise direction so that upper impactor 19 has rotated in a clockwise direction in relation to the slot extension in upper impact anvil 20 as shown;

(2) Rotation of upper shaft 12 and upper torque adjusting unit 16 in sliding key slot connection with upper shaft 12 causes upper torque adjusting unit 16 to further compress upper torque spring 35 which in turn further increases counter clockwise torsion on upper shaft 12; and (3) Upper release spring 36 is further compressed to provide a resultant level of impact of upper impactor 19 against the next higher slot extension of upper impact anvil 20 as shown in FIG. 4.

Figure 3:
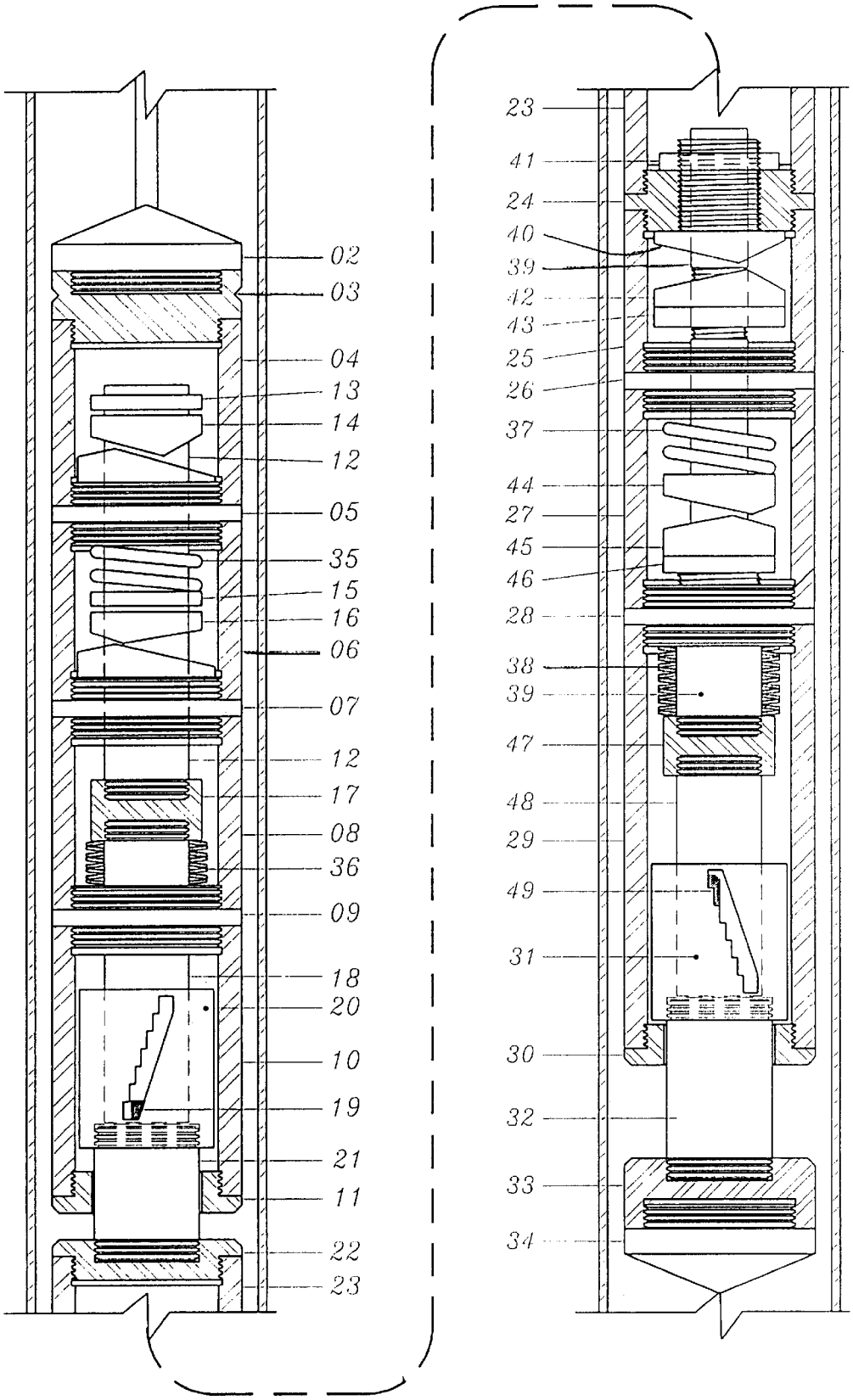

FIG. 3(*b*) depicts the lower portion of the downhole fishing jar mechanism in open position so that tension applied to the fishing string and the upper portion of the fishing jar is transmitted through the lower portion direct to the fish.

FIG. 4 depicts the upper portion of the downhole fishing jar mechanism ready for further application of tension to produce another upward impact.

Figure 5:
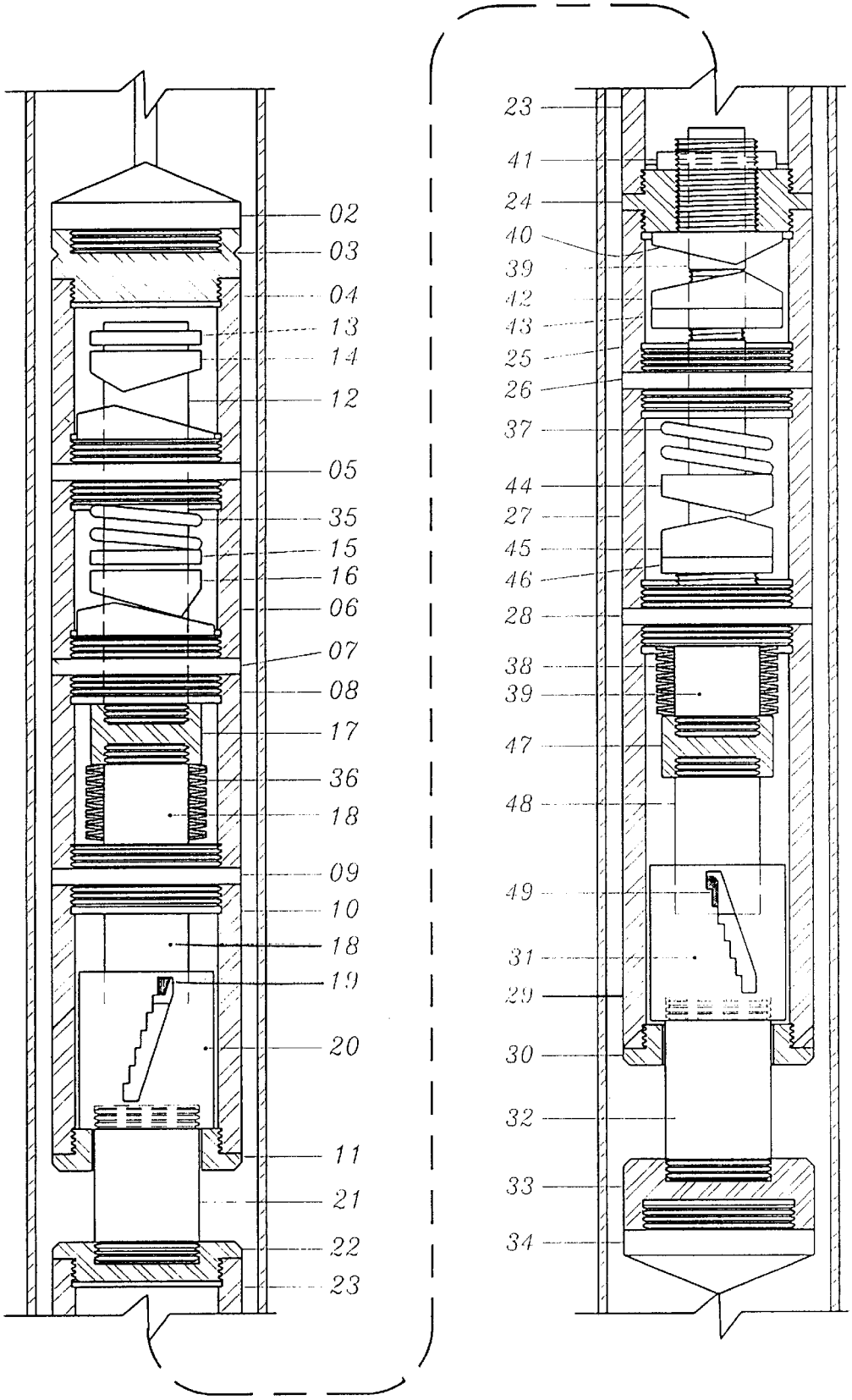

FIG. 5 depicts the upper portion of the downhole fishing jar mechanism after the last impact in a series of upward impacts has been concluded wherein upward tension on the fishing line has been discontinued after the final impact, upper release spring 36 is not in compression, upper impactor 19 is positioned in the uppermost slot extension of upper impact anvil 20 and upper shaft 21 is fully extended downward in upper unit stop 11.

Figure 6:
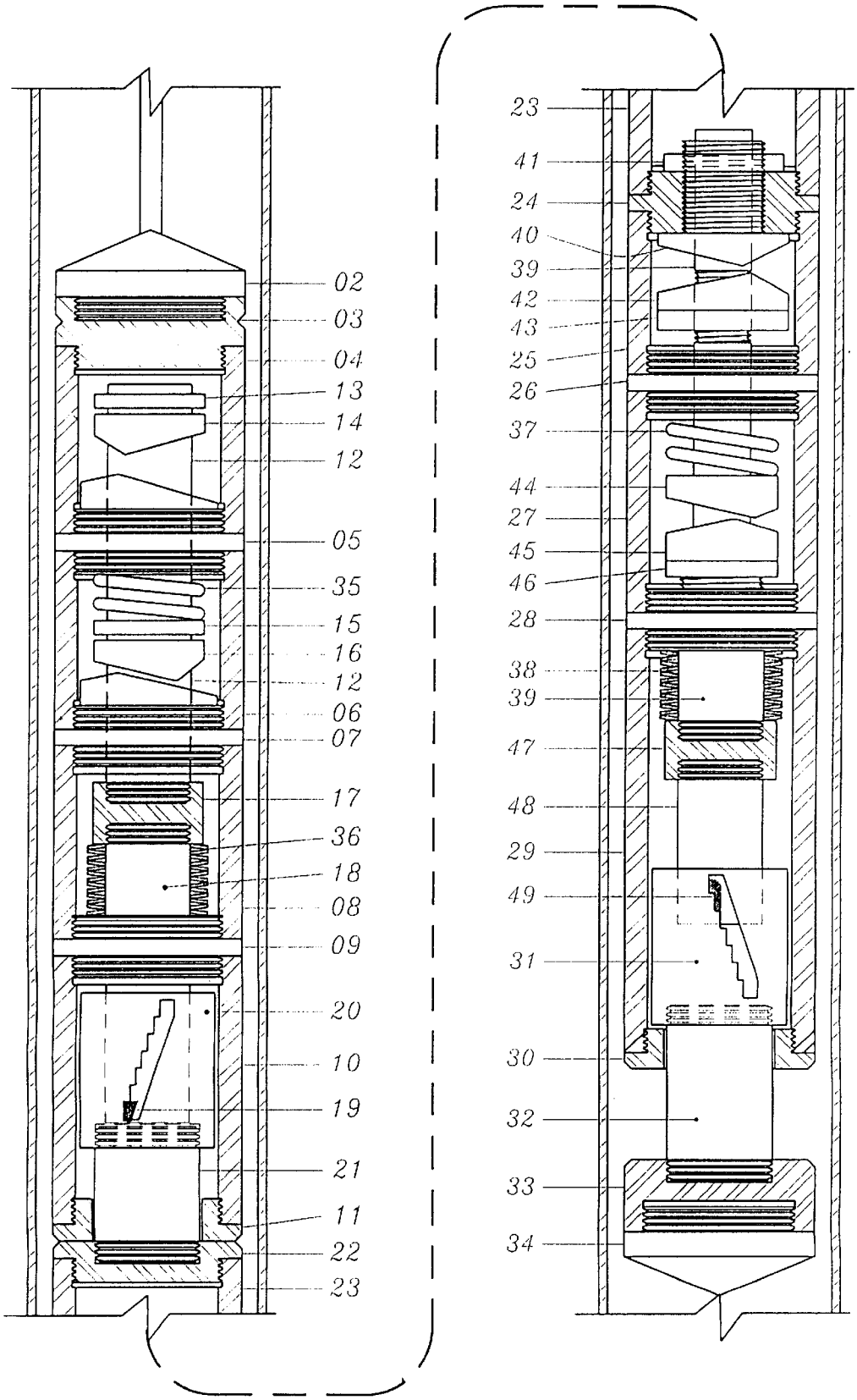

FIG. 6 depicts the upper portion of the downhole fishing jar mechanism in a closed position ready for tension to be applied to produce a series of upward impacts, or for weight of the fishing string to be released causing the lower portion of the downhole fishing jar mechanism to be compressed downward in order to produce a series of downward impacts to the fish.

Figure 7:
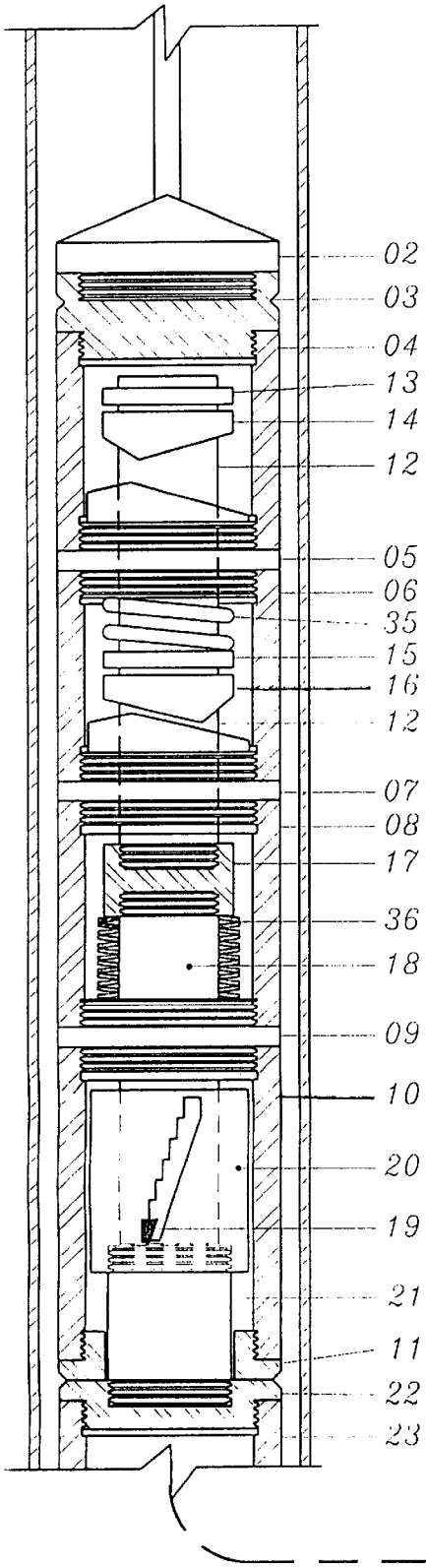
Figure 7:
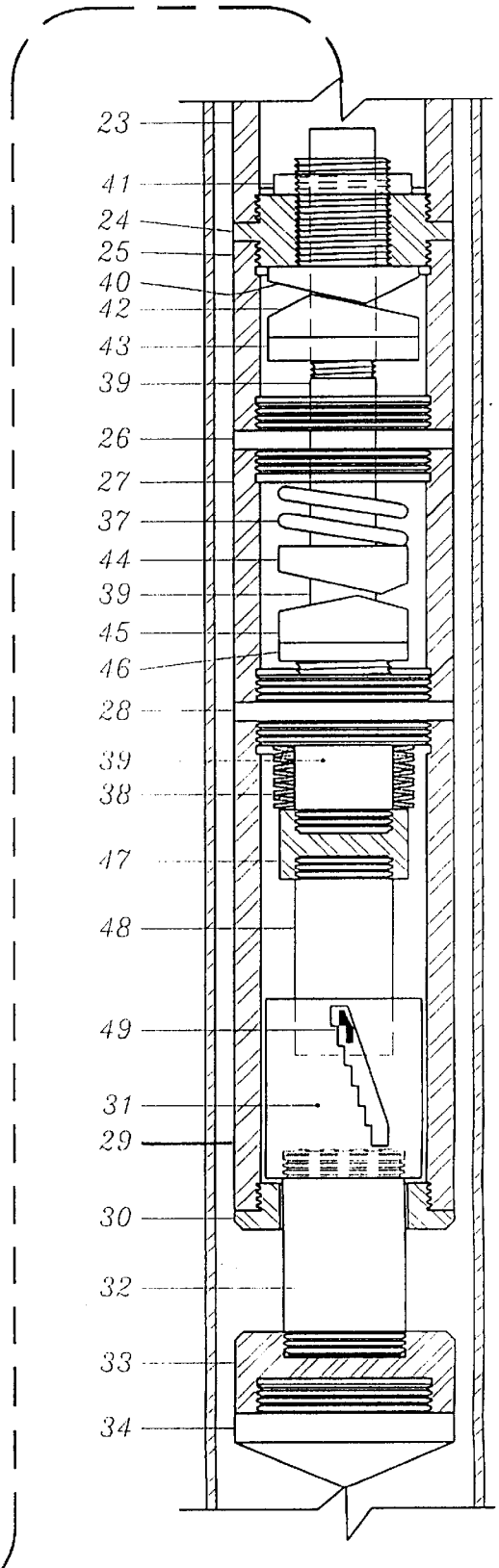

FIG. 7 depicts the lower portion of the downhole fishing jar mechanism with the weight of the fishing string compressing lower release spring 38 causing housing 51 to move downward in relation to lower spring shaft 39 and lower main shaft 48 in which:

(1) The cam surface of lower impact level selector unit 42 acting against the cam surface of lower impact level cam 40 has rotated lower spring shaft 39 and lower main shaft 48 in a clockwise direction so that lower impactor 49 has rotated in a clockwise direction in relation to the slot extension in lower impact anvil 31 as shown;

(2) Clockwise rotation of lower spring shaft 39 and lower torque cam 44 in sliding key slot connection with lower spring shaft 39 causes lower torque cam 44 to further compress lower torque spring 37 which in turn further increases counter clockwise torsion on lower spring shaft 39; and (3) Lower release spring 38 is further compressed to provide a resultant level of impact of lower impactor 49 against the next lower slot extension of lower impact anvil 31 as shown in FIG. 7.

Figure 8:
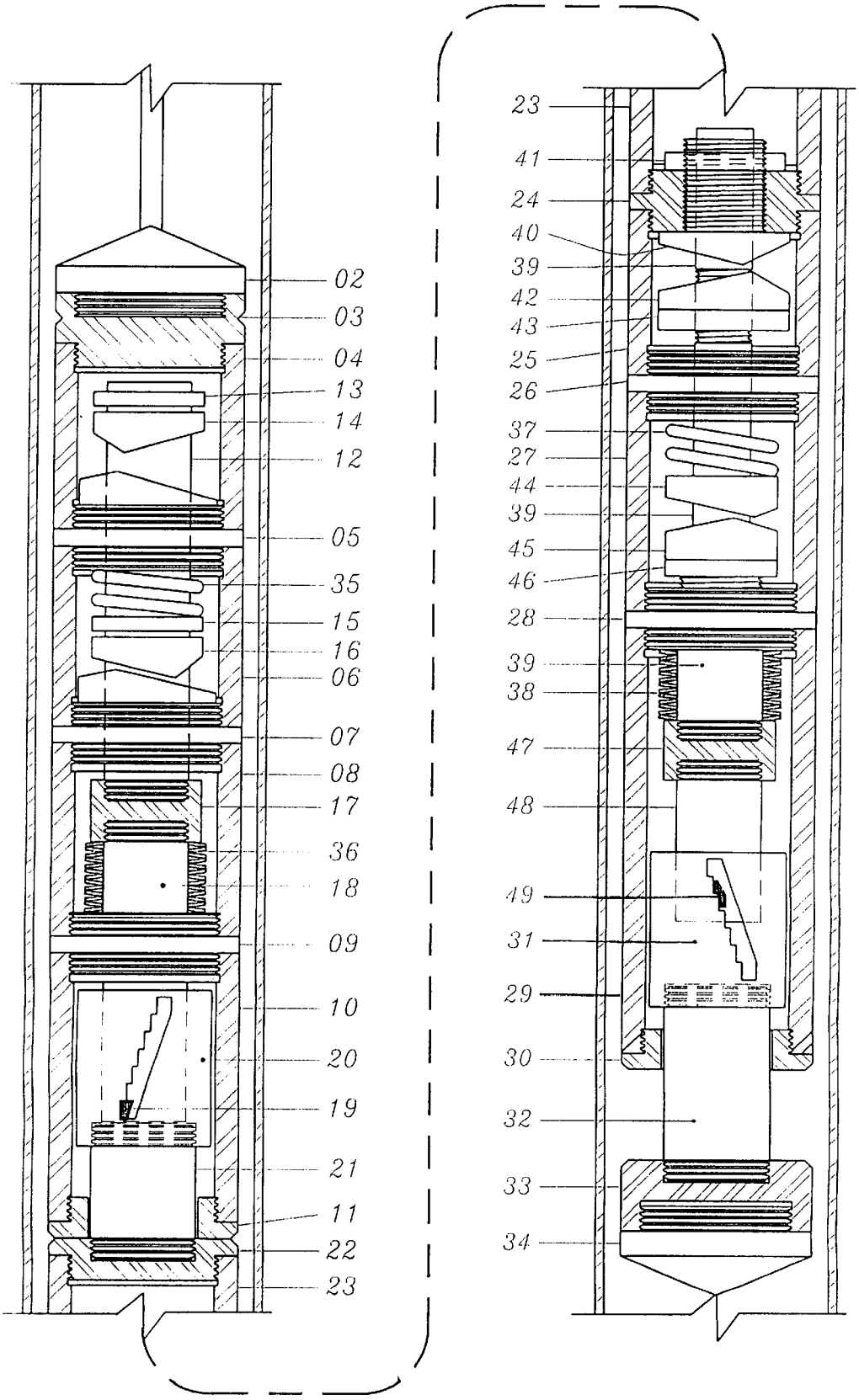

FIG. 8 is ready for the weight of the fishing string to further compress lower release spring 36 causing housing 51 to move further downward in relation to lower spring shaft 39 and lower main shaft 48 as shown in FIG. 7.

Figure 9:
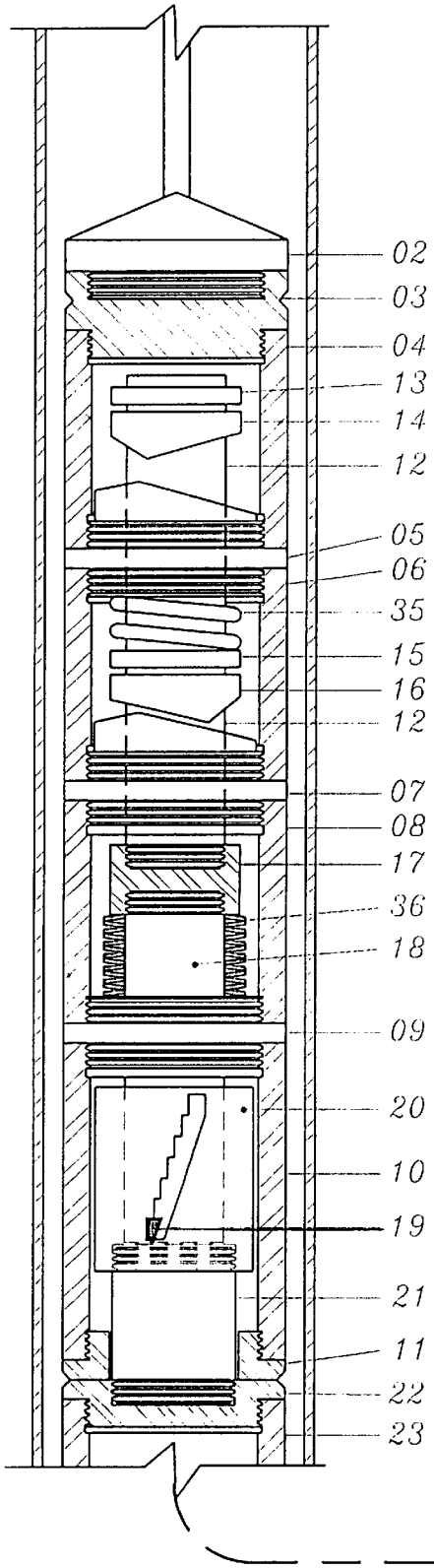
Figure 9:
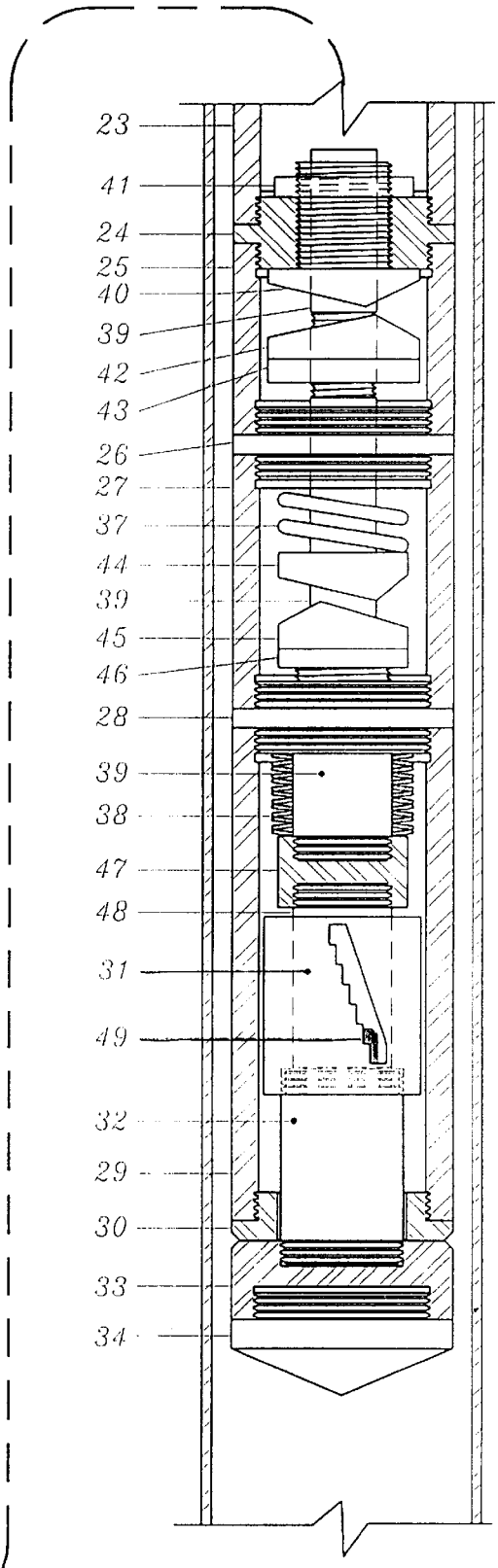

FIG. 9 depicts the lower portion of the downhole fishing jar mechanism after the last impact in a series of downward impacts has been completed wherein downward pressure on the fishing jar has been discontinued after the final impact, lower release spring 38 is not compression, lower impactor 49 is positioned in the lowest slot extension of lower impact anvil 31, and bottom sub 33 is in its uppermost position and in contact with lower unit stop 30.

DESCRIPTION OF PREFERRED EMBODIMENT

A multi-impact up or up-and-down tool as shown in FIGS. 1(*a*), 1(*b*), 2(*a*) and 2(*b*) can be manufactured in several sizes. For example, tool 1 may be provided from 1 9/16 inch outer diameter to 3 inch outer diameter, or greater, for operation from a wire line as the operating string. With well tubing or drill pipe as the operating string, tool 1 can be provided in several sizes ranging from 3 inch outer diameter to 9 inch outer diameter, or greater.

Tool 1 as shown in FIGS. 1(*a*) and 1(*b*) is capable of being connected at top sub 3 to upper operating string 2, and is capable of being connected through bottom sub 33 through an overshot or a spear or other catching tool 34, to a stuck object, commonly known as a fish.

Figure 2:
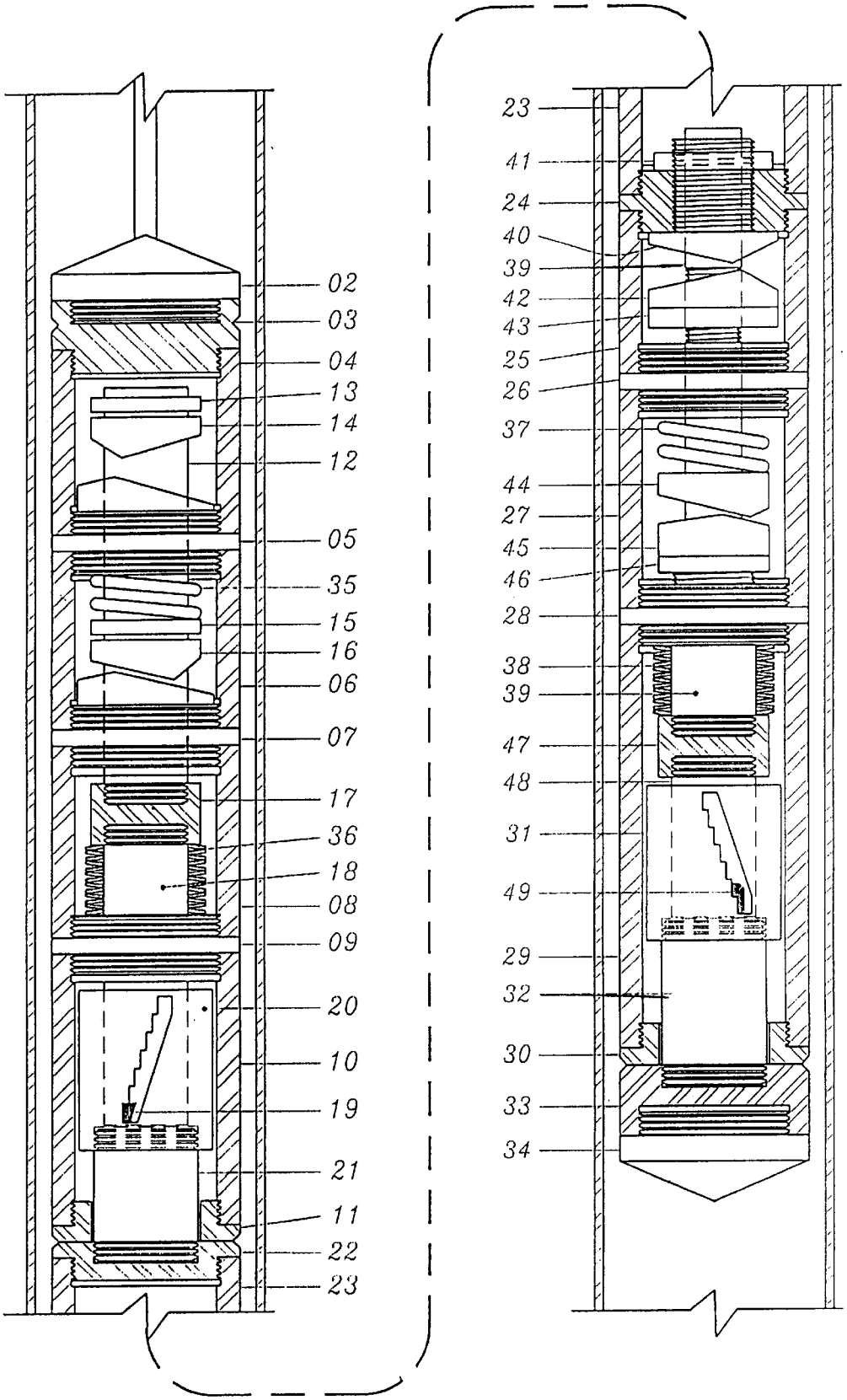
FIGS. 2(*a*), 3(*a*), 4, 5 and 6 are sectional views of the upper portion of the downhole fishing jar mechanism of FIG. 1(*a*), showing impact level selector and actuator, torsional tension section, spring section, impactor, anvil and impactor releasing assembly components of the jar tool at selected times during jar operation.

Tool 1 extends in length responsive to tensional force applied to the operating string from draw works on the earth's surface. The operating string as a whole also stretches along its length. As shown in FIG. 2, while tool 1 is being extended in length by a tensional force, release spring 36 is compressed accordingly and stores energy corresponding to the operating string stretch force. A releasing latch assembly comprises upper impact level selector 14, upper jam nut 13, upper cycle connector 5, upper shaft 12, upper shaft connector 17, upper spring shaft 18 and upper impactor 19. Upper impactor 19 is connected to upper spring shaft 18 which is connected through upper shaft connector 17 and upper shaft 12 to upper impact anvil 20. As the releasing latch assembly unlatches upper release spring 36 is released from compression.

An upper torque assembly comprises an upper torque adjusting unit 16, upper torque jam nut 15, upper torque spring 35 and upper torque connector 7. Upper torque adjusting unit 16 is mounted on upper shaft 12 with upper jam nut 13 which maintains the rotational position of adjusting unit 16 in relation to upper shaft 12, while upper torque adjusting unit 16 mounted on upper shaft 12 allows upper torque adjusting unit 16 to slide longitudinally on upper shaft 12, and is adapted to provide a constant counterclockwise torque pressure to upper shaft 12 as upper torque spring 35 maintains pressure of the cam face of upper torque adjusting unit 16 against the cam face of torque connector 7. (Orientation is looking upward from the bottom sub 33).

As shown in FIG. 1(*b*), 2(*a*), 2(*b*) and 3(*a*), tension force in the operating string pulls housing 50 upwardly and causes upper sub shaft 21 to extend out of housing 50 and causes lower sub shaft 32 to fully extend out of housing 51. The tensional force of the operating string and the force generated by suddenly releasing upper release spring 36 from compression rapidly pushes upper spring shaft 18 and attached upper impactor 19 into impact with an extended portion of upper impact anvil 20 to create an upwardly jarring force communicated through upper sub shaft 21, upper sub shaft connector 22, housing 51, lower unit stop 30, lower impact anvil 31, lower sub shaft 32, bottom sub 33 and lower operating string 34 to the fish.

Housing 50 contains upper cycle body 4, upper torque body 6, upper spring body 8 and main body 10. Upper cycle connector 5 connects upper cycle body 4 and upper torque body 6. Upper torque connector 7 connects upper torque body 6 and upper spring body 8. Upper spring connector 9 connects upper body 8 and main body 10. Upper cycle connector 5 is a tube having outer circumferential threads adapted for screw connector into upper cycle body 4 and upper torque body 6 respectively, interrupted by a shoulder which separates upper threads and lower threads to allow upper cycle body 4 and torque body 6 to tighten against upper shoulder face and lower shoulder face of upper cycle connector 5 without directly contacting each other. The upper end of each cycle connector 5 has a tapering substantially triangular projection projecting longitudinally upward and tapering to a point 90 degrees from the beginning of each taper.

Upper torque connector 7 connects upper torque body 6 and upper spring body 8 and is substantially the same as upper cycle connector 5.

Upper spring connector 9 connects upper body 8 and main body 10 and is substantially the same as upper torque connector 7 except upper spring connector 9 has no triangular projection.

Upper cycle body 4 contains top sub 3, a portion of upper shaft 12, upper jam nut 13, upper impact level selector 14 and the upper portion of upper cycle connector 5. Top sub 3 screws into upper portion of upper cycle body 4 and connects cycle body 4 to an operating string. Top sub 3 provides a fishing neck to allow it to be grasped by an overshot when an operating string is disconnected from top sub 3.

Upper shaft 12 is a cylindrical hardened steel shaft having lower threads for connection to upper shaft connector 17 and upper threads for connection to upper impact level selector 14 and for tightening connection of upper jam nut 13 against upper impact level selector 14. Upper shaft 12 has splines running longitudinally from each end to receive matching splines in upper torque adjusting unit 16 to prevent upper torque adjusting unit 16 from rotation on upper shaft 12 while allowing upper torque adjusting unit 16 to move longitudinally on upper shaft 12.

Upper jam nut 13 is for locking the relative rotational position of upper impact level selector 14 and upper shaft 12. Upper impact level selector 14 is a tube having inner circumferential threads adapted for screw connection onto upper shaft 12. The lower end of impact level selector 14 has a tapering, substantially triangular projection projecting longitudinally downward and tapering to a point 90 degrees from the beginning of each taper.

Upper torque body 6 contains the lower portion of upper shaft 12, upper torque spring 35, upper torque jam nut 15, upper torque adjusting unit 16 and an upper portion of upper torque connector 7.

Upper torque spring 35 comprises a coiled spring that wraps around upper shaft 12 between upper cycle connector 5 and upper torque jam nut 15 for biasing upper torque adjusting unit 16 against upper torque connector 7 so that the tapering substantially triangular upper end projection of upper torque connector 7 is in constant engagement with the tapering substantially triangular lower end projection of upper torque adjusting unit 16 to attempt to rotationally reposition upper torque adjusting unit 16 in a counterclockwise position. (Orientation is looking upward from the bottom sub 32).

Upper torque adjusting unit 16 comprises an outer cylinder having inner circumferential threads adapted for screw connection with an inner cylinder, and an inner cylinder having outer circumferential threads adapted for screw connection with an outer cylinder and having inner splines running longitudinally from each end to receive matching splines in upper shaft 12. The lower end of an outer cylinder has a tapering, substantially triangular projection projecting longitudinally downward and tapering to a point 90 degrees from the beginning of each taper.

Upper torque jam nut 15 is for locking the relative rotational position of outer cylinder and inner cylinder of upper torque adjusting unit 16.

Upper spring body 8 contains upper shaft connector 17, upper spring shaft 18 and upper release spring 36.

Upper shaft connector 17 is a tube having inner circumferential threads in each end to receive upper shaft 12 in the upper portion of upper shaft connector 17 and to receive upper spring shaft 18 in the lower portion of upper shaft connector 17. The central portion of upper shaft connector 17 is solid and forms a shoulder for upper shaft 12 and upper spring shaft 18 to tighten against.

Upper spring shaft 18 is a cylindrical hardened steel shaft having lower threads for connection to upper impactor 19 and having upper threads for connection to upper shaft connector 17.

Upper release spring 36 is a series of disk spring washers also known as belleville washers.

Upper main body 10 contains upper impact anvil 20, upper impactor 19, upper sub shaft 22 and upper unit stop 11. Upper impactor 19 is a tube having inner circumferential threads adapted for screw connection onto upper spring shaft 18, with the outer portion having two splines being 180 degrees circumferentially from each other projecting longitudinally from upper end to lower end with the splines being offset by 10 degrees in a clockwise direction from upper end to lower end, with each spline being 10 degrees wide from upper to lower end and with each spline fitted to match the slots in upper impact anvil 20.

Upper impact anvil 20 is a tube having two slots located 180 degrees circumferentially from each other extending longitudinally from the lower end to 90 percent of the length of the tube with the clockwise edge (looking upward from bottom sub 22) of each slot being a straight line extending upward from lower end to a point rotationally 90 degrees in a clockwise direction from the lower end starting point, with rotation being perpendicular to the centerline of upper impact anvil 20. (Orientation is looking upward from the lower end of upper impact anvil 20). The top opening of each slot extends 20 degrees rotationally in a counterclockwise direction from the upper end of the clockwise side of each slot with the top portion of each slot being perpendicular to the center line of upper impact anvil 20. The counterclockwise side of each slot extends downward from the counterclockwise upper and of each slot in a series of counterclockwise equally spaced rotational offsets. The clockwise side of each rotational offset extends downward for the length of each rotational offset 10 degrees in a clockwise direction and parallel to the center line of upper impact anvil 20, then extends 12 degrees rotationally in a counterclockwise direction perpendicular to the center line of upper impact anvil 20.

Upper sub shaft 21 is a cylindrical hardened steel shaft having lower threads for connection to upper sub shaft connector 22 and has upper threads for connection to upper impact anvil 20. Upper sub shaft 21 has splines running longitudinally from each end to receive matching splines in upper unit stop 11 to prevent upper sub shaft 21 from rotation in relation to upper unit stop 11 while allowing upper sub shaft 21 to move longitudinally in upper unit stop Upper unit stop 11 is a tube having outer circumferential threads adapted for screw connection into main body 10, the inner portion having splines running longitudinally from each end to receive matching splines in upper sub shaft 21. Upper unit stop 11 is adapted for receiving upper sub shaft 21.

Upper sub shaft connector 22 is a tube having outer circumferential threads adapted for screw connection into upper/lower body 23 and having inner threads on an upper end to receive upper sub shaft 21.

Tool 1 compresses in length responsive to weight of the fishing string from draw works on the surface of the earth. While tool 1 is being compressed in length by weight of the fishing string, or by weight of sinker bars in the case of wireline, lower release spring 38 is compressed accordingly and stores energy corresponding to the operating string compression force. A releasing latch assembly comprises lower impact level selector 42, lower jam nut 43, lower cycle connector 24, lower spring shaft 39, and lower impactor 49. Lower impactor 49 is connected to lower main shaft 48 which is connected through lower shaft connector 47 and lower spring shaft 39 to lower impact level selector 42 and is adapted to strike lower impact anvil 31 as the releasing latch assembly unlatches, thereby releasing lower release spring 38 from compression.

A lower torque assembly comprises a lower torque adjusting unit 45, lower torque jam nut 46, lower spring connector 28, lower torque cam 44, and lower torque spring 37. Lower torque cam 44 is mounted on lower spring shaft 39 so that the rotational position of lower torque cam 44 is maintained in relation to lower spring shaft 39, while lower torque cam 44 is free to move longitudinally on lower spring shaft 39, and is adapted to provide a constant counterclockwise torque pressure to lower spring shaft 39 as lower torque spring 37 maintain pressure of cam face of lower torque cam 44 against cam face of lower torque adjusting unit 45. (Orientation is looking upward from bottom sub 33).

Compression force in the operating string compresses housing 51 downward and causes lower sub shaft 32 to move upward into housing 51. The compression force of the operating string and the downward force generated by suddenly releasing lower release spring 38 from compression rapidly push lower main shaft 48 and attached lower impactor 49 into impact with an extended portion of lower impact anvil 31 to create a downward jarring force communicated through lower sub shaft 32, bottom sub 33, and lower operating string 34 to the fish.

Housing 51 contains upper/lower body 23 lower cycle body 25, lower torque body 27, and lower spring body 29. Lower cycle connector 24 connects upper/lower body 23 and lower cycle body 25. Lower torque connector 26 connects lower cycle body 25 and lower torque body 27. Lower spring connector 28 connects lower torque body 27 and lower spring body 29. Lower cycle connector 24 is a tube having outer circumferential threads adapted for screw connection into upper/lower body 23 and lower cycle body 25, respectively, interrupted by a shoulder which separates upper threads and lower threads to allow upper/lower body 23 and lower cycle body 25 to tighten without directly contacting each other. Lower cycle connector 24 has inner circumferential threads adapted for screw connection with lower impact level selector 40.

Lower torque connector 26 connects lower body 25 and lower torque body 27 and is substantially the same as upper spring connector 9.

Lower spring connector 28 connects lower torque body 27 and lower spring body 29. Lower spring connector 28 is a tube having outer circumferential threads adapted for screw connection into lower torque body 27 and lower spring body 29, respectively, interrupted by a shoulder which separates upper threads and lower threads to allow lower torque body 27 and lower spring body 29 to tighten without directly contacting each other. Lower spring connector 28 has outer circumferential threads on an upper extension adapted for screw connection with lower torque adjusting unit 45 and lower torque jam nut 46.

Upper/lower body 23 contains lower jam nut 41, a portion of lower spring shaft 39 and the upper portion of lower impact level cam 40. Upper sub shaft connector 22 screws into upper portion of upper/lower body 23 and lower cycle connector 24 screws into lower body 23.

Lower spring shaft 30 is a cylindrical hardened steel shaft having lower threads for connection to lower shaft connector 47 and threads on the upper portion for connection to lower impact selector 42 and for tightening connection of lower jam nut 43 against lower impact selector unit 42. Lower spring shaft 39 has splines running longitudinally from each end to receive matching splines in lower torque cam 44 to prevent lower torque cam 44 from rotating on lower spring shaft 39 while allowing lower torque cam 44 to move longitudinally on lower spring shaft 39.

Lower impact level cam 40 is a tube having outer circumferential threads adapted for screw connection into lower cycle connector 24. The lower end of lower impact level cam 40 has a tapering, substantially triangular projection projecting longitudinally downward and tapering to a point 90 degrees from the beginning of each taper.

Lower jam nut 41 is for locking the relative rotational position of lower impact level cam 40 and lower cycle connector 24.

Lower cycle body 25 contains a portion of lower spring shaft 39, the lower portion of lower impact level cam 40, lower impact selector unit 42, and lower jam nut 43.

Impact selector unit 42 is a tube having inner circumferential threads adapted for screw connection onto lower spring shaft 39. The upper end of impact selector unit 42 has a tapering substantially triangular projection projecting upward and tapering to a point 90 degrees from the beginning of each taper.

Lower jam nut 43 is for locking the relative rotational position of impact selector unit 42 and lower spring shaft 39.

Lower torque body 27 contains a portion of lower spring shaft 39, lower torque spring 37, lower torque cam 44, lower torque adjusting unit 45, upper end of lower spring connector 28, and lower torque jam nut 46.

Lower torque spring 37 comprises a coiled spring that wraps around lower spring shaft 30 between lower torque connector 26 and lower torque cam 44 for biasing lower torque cam 44 against lower torque adjusting unit 45 so that the tapering substantially triangular upper end projection of lower torque adjusting unit 45 is in constant engagement with the tapering substantially triangular lower end projection of lower torque cam 44 to attempt to rotationally reposition lower torque cam 44 in a counterclockwise position. (Orientation is looking upward from bottom sub 33).

Lower torque cam 44 is a cylinder having inner splines running longitudinally from each end to receive matching splines in lower spring shaft 39. The lower end of lower torque cam 44 has a tapering substantially triangular projection projecting longitudinally downward tapering to a point 90 degrees from the beginning of each taper.

Lower torque adjusting unit 45 is a cylinder with inner circumferential threads adapted for screw connection to lower spring connector 28. The upper end of lower torque adjusting unit 45 has a tapering substantially triangular projection projecting longitudinally upward and tapering to a point 90 degrees from the beginning of each taper.

Lower torque jam nut 46 is for locking the relative rotational position of lower torque adjusting unit 45 and lower spring connector 28.

Lower spring body 29 contains a lower portion of lower spring shaft 39, lower release spring 30, lower shaft connector 47, lower main shaft 48, lower impact anvil 31, lower impactor 49, lower sub shaft 32, and lower unit stop 30.

Lower release spring 38 is a series of disk spring washers also known as belleville washers.

Lower shaft connector 47 is a tube having inner circumferential threads in each end for screw connection to the lower end of lower spring shaft 39 and for screw connection to the upper end of lower main shaft 48. The central portion of lower shaft connector 47 is solid and forms a shoulder for lower spring shaft 39 and lower main shaft 48 to tighten against.

Lower main shaft 48 is a cylindrical hardened steel shaft having lower threads for screw connection to lower impactor 49 and having upper threads for screw connection to lower shaft connector 47.

Lower impact anvil 31 is substantially the same as upper impact anvil 20 except that the slot extends upward in a counterclockwise direction.

Lower impactor 49 is substantially the same as upper impactor 19 except that the two splines projecting longitudinally from upper end to lower end are offset in a counterclockwise direction and with each spline fitted to match the slots in lower impact anvil 31.

Lower sub shaft 32 is a cylindrical hardened steel shaft having lower threads for screw connection to bottom sub 33 and has upper threads for screw connection to lower impact anvil 31. Lower sub shaft 21 has splines running longitudinally from each end to receive matching splines in lower unit stop 30 to prevent lower sub shaft 32 from rotation in relation to lower unit stop 30 while allowing lower sub shaft 32 to more longitudinally in lower unit stop 30.

Lower unit stop 30 is a tube having outer circumferential threads adapted for screw connection into lower spring body 29, the inner portion having splines running longitudinally from each end to receive matching splines in lower sub shaft 32. Lower unit stop 30 is adapted for receiving lower sub shaft 32.

Bottom sub 33 is a solid body having inner threads on an upper end for screw connection to lower sub shaft 32 and having inner threads on a lower end for screw connection to a lower operating string catching tool, usually an overshot or a spear.

OPERATION OF PREFERRED EMBODIMENT

Referring now to FIGS. 1(*a*), 1(*b*), 2(*a*) and 2(*b*), tool 1 is shown in closed position and is ready to provide a series of rapid upward impacts against a stuck object in a well bore, or to provide a series of rapid downward impacts against a stuck object in a well bore. As tensional force is applied to an operating string from the earth's surface, tool 1 is extended in length by upward movement of an operating string 2 connected through top sub 3, upper housing 50, lower housing 51, bottom sub 33 and lower operating string 34 to a stuck object (a fish) in the well bore. As tool 1 extends in length, lower housing 51 is drawn upward causing lower unit stop 30 to move upwardly on lower sub shaft 32 until lower unit stop 30 comes into contact with lower impact anvil 31 connected through lower sub shaft 32, bottom sub 33, and lower operating string 34 to a stuck object.

As tool 1 continues to extend in length, upper spring connector 9 compresses upper release spring 36 against upper shaft connector 17 and housing 50 moves upward in relation to upper shaft 12 and upper spring shaft 18. Upper unit stop 11 moves upward in relation to upper sub shaft 21 causing an opening in the jar between housing 50 and housing 51.

As tool 1 continues to open, upper cycle connector 5 contacts the cam surface of upper impact selector 14 and rotates shaft 12 in a clockwise direction. (Orientation is looking up from bottom sub 33).

As shaft 12 rotates in a clockwise direction, upper torque adjusting unit 16 rotates against the cam surface of upper torque connector 7, increasing torque pressure in a counterclockwise direction on upper shaft 12 and upper spring shaft 18 and forcing upper impactor 19 to maintain a counterclockwise pressure against the counterclockwise slot walls in upper impact anvil 20.

As upper impact selector 14 rotates in a clockwise direction, impactor 19 also rotates in a clockwise direction until impactor 19 rotates free of the slot extension in upper impact anvil 20.

When impactor 19 rotates clear of the slot extension in upper impact anvil 20, upper release spring 36 is free to expand until impactor 19 comes into contact with the next slot extension in upper impact anvil 20.

The resultant impact from impactor 19 striking the next slot extension in impactor 20 is transferred directly through upper sub shaft 21 connected to housing 51 connected through lower sub shaft 32 to the fish.

As upper impact level selector 14 moves upward and is no longer in contact with the cam surface of upper cycle connector 5, downward force of upper torque spring 35 against upper torque adjusting unit 16 acting against cam surface of upper torque connector 7 causes upper shaft 12 to rotate in a counterclockwise direction. (orientation is looking up from bottom sub 33).

Upper shaft 12 and upper spring shaft 18 continue to rotate in a counterclockwise direction until impactor 19 impacts the next slot extension in impactor 20 as described above and upper spring shaft 18 stops in a new position slightly clockwise from a prior position.

As housing 50 continues to move upward and tool 1 continues to open, upper cycle connector 5 again comes into contact with the cam surface of upper impact selector 14 and rotates upper shaft 12 in a clockwise direction, and torque pressure is again increased in a counter clockwise direction on upper shaft 12 and upper spring shaft 18 as upper torque adjusting unit 16 rotates against the cam surface of upper torque connector 7.

As a result of upper impact level selector 14 having to rotate further in a clockwise direction before upper impactor 19 is released to impact again upper impact anvil 20, upper release spring 36 is further compressed and a greater impact level is delivered to the fish compared to a prior impact. Thus each successive impact delivered is greater than the prior impact.

At the end of a series of rapid impacts delivered as described above, impactor 19 is released to impact the last or uppermost slot in upper impact anvil 20, and the final impact of a series is delivered to the fish. Tensional force to an operating string from the earth's surface is then released, the weight of housing 50 will cause it to descend on upper sub shaft 21 until upper unit stop 11 comes into contact with upper sub shaft connector 22 and impactor 19 will move downward to the lowest slot position in upper impact anvil 20.

Lower impactor 49 will prevent lower impact anvil 31 from moving upward on lower main shaft 48 and lower unit stop 30 will remain at its uppermost position in relation to lower sub shaft 32.

Tensional force can again be applied to an operating string from the earth's surface and tool 1 will again extend in length for a new series of upward impacts as described above. This series of upward impacts can again continue through a full series of upward impacts unless (1) the fish comes free, or (2) sufficient tensional force cannot be applied to complete a series of increasing impact levels. In the event that sufficient tensional force cannot be applied to an operating string from the earth's surface, tensional force is released, the weight of housing 50 will again close the jar, and a new series of upward impacts can begin by the application of a tensional force from the earth's surface.

If the fish comes free at any point, the jar will cease to impact and the fish is removed in the usual way.

To provide a series of rapid downward impacts against a stuck object in the well bore, tensional force is released to an operating string and the weight of the operating string (or sinker bars) provides a downward pressure on tool 1 causing downward movement of housing 50 and housing 51 in relation to lower spring shaft 39, lower shaft connector 47, lower main shaft 48, lower impactor 49, lower impact anvil 31, lower sub shaft 32, bottom sub 33, lower operating string 34 and a stuck object in the well bore.

Housing 51 moves downward in unison with lower impact level cam 40, lower torque connector 26, lower spring connector 28, and lower unit stop 30.

As lower impact level cam 40 moves downward it comes into contact with the cam face of lower impact selector 42, and as downward movement of lower impact cam 40 continues, impact selector 42 is forced to rotate in a clockwise direction. (Orientation is looking upward from bottom sub 33).

As lower torque cam 44 rotates in a clockwise direction, it is forced to move upward by the cam face of lower torque adjusting unit 45 and further compresses lower torque spring 37 which in turn increases the counter clockwise torque pressure on lower spring shaft 39, lower shaft connector 47, lower main shaft 48, and lower impactor 49.

As lower spring connector 28 moves downward it compresses lower release spring 38 against lower shaft connector 47.

Lower unit stop 30 moves downward on lower sub shaft 32. As lower impact selector unit 42 rotates in a clockwise direction, lower spring shaft 39, lower shaft connector 47, lower main shaft 48, and lower impactor 49 also rotate in a clockwise direction until impactor 49 rotates clear of the slot extension in lower impact anvil 31. When lower impactor 49 rotates clear of the slot extension in lower impact anvil 31, lower release spring 38 is free to expand downward until lower impactor 49 comes into contact with the next slot extension in lower impact anvil 31.

The resultant downward impact from lower impactor 49 striking the next slot extension in lower impact anvil 31 is transferred directly through lower impact anvil 31, lower sub shaft 32, bottom sub 33, and lower operating string 34 to the stuck object in the well bore.

Lower release spring 38 expands and causes downward movement of lower impact selector unit 42 until lower impact selector unit 42 is no longer in contact with lower impact level cam 40. Counterclockwise torque pressure of lower torque cam 41 pressured against lower torque adjusting unit 45 by lower torque spring 37 forces lower spring shaft 39, lower shaft connector 47, lower main shaft 48 and lower impactor 49 to rotate in a counterclockwise direction until lower impactor 49 impacts against the next slot extension in lower impact anvil 31.

As downward pressure on tool 1 causes further downward movement of housing 51 in relation to lower spring shaft 39, lower impact level cam 40 again moves downward and comes into contact with the cam face of lower impact selector 42 which again rotates lower impactor 49 clear of the slot extension in lower impact anvil 31, allowing lower release spring 38 to expand downward until lower impactor 49 comes into contact with the next slot extension in lower impact anvil 31.

Again the resultant downward impact from lower impactor 49 striking the next slot extension in lower impact anvil 31 is transferred directly to the stuck object in the well bore, and lower spring shaft 39 stops in a new position slightly clockwise from its prior impact position. This results in lower impact selector unit 42 having to rotate further in a clockwise direction before lower impactor 49 is released to again impact lower impact anvil 31. Thus each successive downward impact is greater than the prior impact.

At the end of a series of rapid downward impacts, impactor 49 is released to impact the last or lowest slot in lower impact anvil 31, and the final impact of a series is delivered to the fish. Tensional force to an operating string is then increased from the earth's surface causing housing 50 and housing 51 to move upward in relation to lower impactor 49 until lower unit stop 30 extends upward on lower sub shaft 32 and until lower unit stop 30 comes into contact with lower impact anvil 31. Lower impactor 49 is now repositioned to the uppermost slot extension in lower impact anvil 31, and a new downward series of impact forces can be initiated by releasing tensional force to an operating string, or a series of rapid upward impacts against a stuck object in the well bore can be initiated by the further application of a tensional force applied to an operating string from the earth's surface.

I claim:

1. A multi-impact jarring tool, comprising:

(a) a first operating mandrel reciprocatingly mounted within a first housing body with the first mandrel and the first housing body adapted to be connected into a well bore operating string or drill string, the first mandrel and the first body forming an impact hammer and an impact anvil for creating a sequence of upwardly directed impact forces;

(b) a first release spring adapted to be compressed between the first mandrel and the first housing body responsive to tensional force applied to the first mandrel by the operating or drill string; and (c) first releasable latching means connected between the first mandrel and the first housing body for compressing the first release spring downward during movement of the first mandrel until the first latching means is suddenly released when moved past each of a series of preset release positions, each sudden release of the first release spring resulting in sudden upward movement of the first mandrel responsive to the tensional force in the operating string or drill string and resulting in sequential impacts of the hammer with the anvil.

2. A multi-impact jarring tool according to claim 1, further comprising:

(d) a second operating mandrel reciprocatingly mounted within a second housing body, the second housing body being connected to the first housing body, with the second mandrel and second housing adapted to be connected into a well bore operating string or drill string, the second mandrel and the second body forming an impact hammer and an impact anvil for creating a sequence of downwardly directed impact forces;

(e) a second impact release spring adapted to be compressed between the second mandrel and the second housing body responsive to compressional force applied to the second mandrel by the weight of the operating or drill string;

(f) second releasable latching means connected between the second mandrel and the second housing body for compressing the second release spring upward during movement of the second mandrel until the second latching means is suddenly released when moved past each of a series of preset release positions, each sudden release of the second release spring resulting in sudden downward movement of the second mandrel responsive to compressional force in the operating string or drill string and resulting in sequential impacts of the hammer with the anvil.

* * * * *